United States Patent [19]

Ikeda

[11] Patent Number: 4,588,678

[45] Date of Patent: May 13, 1986

[54] SILVER HALIDE PHOTOGRAPHIC MATERIAL AND DEVELOPMENT METHOD

[75] Inventor: Hideo Ikeda, Kanagawa, Japan

[73] Assignee: Fuji Photo Film Co., Ltd., Kanagawa, Japan

[21] Appl. No.: 657,694

[22] Filed: Oct. 4, 1984

[30] Foreign Application Priority Data

Oct. 4, 1983 [JP] Japan ..... 58-185305

[51] Int. Cl.[4] ..... G03C 5/30

[52] U.S. Cl. ..... 430/420; 430/426; 430/434; 430/567; 430/355

[58] Field of Search ..... 430/426, 420, 434, 567–569, 430/355

[56] References Cited

U.S. PATENT DOCUMENTS

| | | | |
|---|---|---|---|
| 3,232,761 | 2/1966 | Allen et al. | 430/426 |
| 3,482,982 | 12/1969 | Miyata | 430/569 |
| 4,259,438 | 3/1981 | Falxa et al. | 430/569 |
| 4,349,622 | 9/1982 | Koitabashi et al. | 430/569 |
| 4,444,877 | 4/1984 | Koitabashi et al. | 430/569 |
| 4,477,564 | 10/1984 | Cellone et al. | 430/567 |

*Primary Examiner*—Mary F. Downey

*Attorney, Agent, or Firm*—Sughrue, Mion, Zinn Macpeak & Seas

[57] ABSTRACT

A silver halide photographic material and a photographic development method are described, wherein the development method is carried out using a processing liquid containing a dialdehyde series hardening agent, and the photographic material comprises a support having thereon at least a silver halide emulsion layer containing silver halide grains having a silver iodide content higher than 1.5 mole %, with the silver iodide distribution in the silver halide grains being homogeneous throughout the grains or the silver iodide content being higher in the internal portion than in the surface portion of the silver halide grains.

15 Claims, 1 Drawing Figure

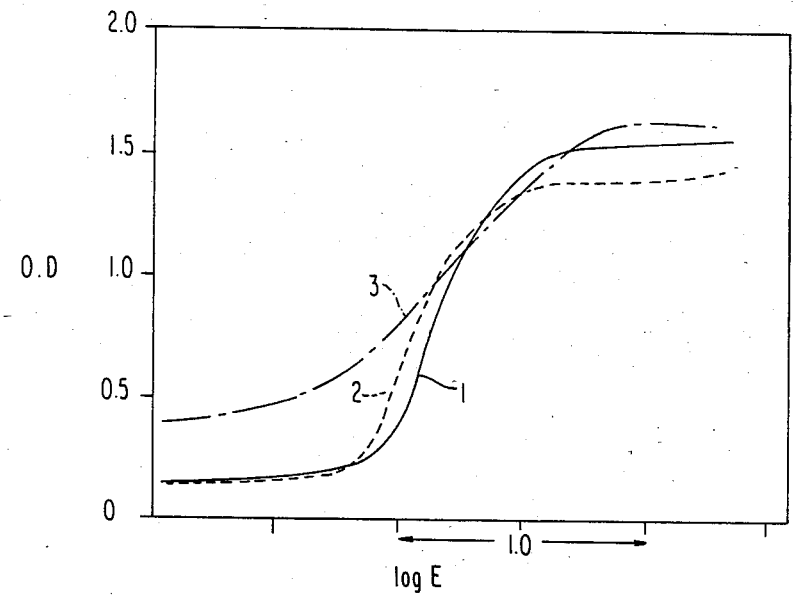
2.0
1.5
O.D
1.0
0.5
0
3
2
1
1.0
log E

SILVER HALIDE PHOTOGRAPHIC MATERIAL AND DEVELOPMENT METHOD

FIELD OF THE INVENTION

This invention relates to a silver halide photographic material which can be quickly processed by a development method using a processing liquid containing a dialdehyde series hardening agent. More particularly, the invention relates to a silver halide photographic material capable of giving images having excellent properties by processing with a processing liquid containing a dialdehyde series hardening agent as a result of defining the silver iodide distribution in silver halide grains.

BACKGROUND OF THE INVENTION

As a process for efficiently developing silver halide photographic materials (hereinafter referred to as photographic materials), a high temperature development, and in particular a high temperature quick processing by an automatic processor, is known, and such has been applied to various kinds of photographic materials with an improved effect. However, because the photographic material is processed at high temperature, it is necessary to increase the physical strength of the silver halide emulsion layers of the photographic material during processing for preventing the emulsion layers from becoming too brittle and thus being damaged by the pressing action of rollers and belts in the automatic processor. Accordingly, a counterplan for increasing and maintaining the physical strength of the emulsion layers in the developer with the progress of the development must be taken. For the purpose, there is a technique of processing which is performed with the addition of a dialdehyde series hardening agent to a developer. This technique of processing is particularly excellent for the quick processing of radiographic lightsensitive materials, and has already been widely used. Such technique of processing is described, for example, in U.S. Pat. No. 3,025,779, British Pat. No. 825,544, Japanese Patent Publication No. 47045/76, etc.

According to this technique of processing, the total processing time is shortened by high temperature processing, and the purposes of quick processing may be attained to some extent, but when the developing process is performed using a developer containing an aldehyde, and particularly an aliphatic dialdehyde as a hardening agent, the formation of fog becomes severe. Furthermore, this tendency is increased with increasing content of silver iodide (particularly a silver iodide content larger than 1.5 mole%) in the silver halide grains of the photographic material. Also, the increase of the content of silver iodide causes not only the severe formation of fog but also the problems of the change of the characteristic curve (e.g., reducing contrast), the deterioration in graininess, etc.

The formation of fog occurring when photographic materials are processed by a developer containing such a dialdehyde series hardening agent can be prevented to some extent by using a strong organic antifoggant such as benzotriazole, 1-phenyl-5-mercaptotetrazole, etc. (see, for example, *Photographic Processing Chemistry*, L. F. Mason, page 40, etc.), but even by using the foregoing antifoggant, the formation of fog cannot be prevented for photographic materials having a particularly high content of silver iodide (i.e., larger than 1.5 mole% silver iodide).

SUMMARY OF THE INVENTION

The object of this invention is, therefore, to provide a silver halide photographic material containing silver halide grains having a silver halide content of higher than 1.5 mole%, which causes less fog, gives less change or distortion of the characteristic curve of images, and lessens deterioration in graininess of images when the photographic material is processed by a processing liquid containing a dialdehyde series hardening agent.

As the results of various investigations, the inventor has discovered that the above-described object can be attained by the photographic material and development method of this invention as set forth below.

That is, the invention provides a silver halide photographic material which is processed with a processing liquid containing a dialdehyde series hardening agent, comprising a support having thereon at least a silver halide emulsion layer containing silver halide grains having a silver iodide content of higher than 1.5 mole%, the silver iodide distribution in the silver halide grains being homogeneous throughout the grain or the silver iodide content being higher in the internal portion than in the surface portion of the silver halide grain. In another aspect, the invention involves a development method wherein the photographic material of the invention is processed using a processing liquid containing a dialdehyde series hardening agent.

BRIEF DESCRIPTION OF THE DRAWING

The FIGURE is a graph showing the characteristic curves of Samples 1 to 3 prepared in Example 1 of this invention, wherein the axis of the ordinate shows an optical density (O.D.) and the axis of the abscissa shows the logarithm of the exposure amount (log E).

DESCRIPTION OF PREFERRED EMBODIMENTS

In conventional photographic materials which are processed by a processing liquid containing a dialdehyde series hardening agent, the silver iodide content in the silver halide grains of such photographic materials is low.

If the content of silver iodide is increased for the purpose of increasing the sensitivity of a conventional photographic material, the occurrence of the above-described disadvantages such as the increase of fog, the reduction of contrast, the deterioration in graininess, etc., becomes undesirably severe.

However, it has now been found that when the silver iodide content in the silver halide grains is higher than 1.5 mole%, the above-described difficulties can, surprisingly, be overcome by employing silver halide grains having specific silver iodide distribution as defined in this invention.

Practical examples of the dialdehyde series hardening agent which is used in this invention include β-methylglutaraldehyde, glutaraldehyde, α-methylglutaraldehyde, maleic dialdehyde, succinic dialdehyde, methoxysuccinic dialdehyde, α,α-dimethylglutaraldehyde, methylmaleic dialdehyde, methylsuccinic dialdehyde, α-methyl-β-ethoxyglutaraldehyde, α-n-butoxyglutaraldhyde, α-ethyl-β-ethoxyglutaraldehyde, β-n-butoxyglutaraldehyde, α,α-dimethoxysuccinic dialdehyde, β-isopropoxysuccinic dialdehyde, α,α-diethylsuccinic dialdehyde, and dibutylmaleic dialdehyde.

Such a dialdehyde series hardening agent is typically used in an amount of from 1 to 20 g, and preferably from 3 to 15 g, per liter of the processing liquid. The processing liquid containing the dialdehyde series hardening agent may be a developer or a pre-bath which is used before the developer.

By the terminology "the silver iodide distribution in the silver halide grains is homogeneous" as used herein is meant that when the silver halide grains are divided into fine portions (e.g., divided in fine portions of equal volume throughout the center to the surface thereof), the silver iodide content of any fine portion is approximately the same as the mean silver iodide content of the whole silver halide grains, and particularly is within 10%, and preferably is within 5%, of the mean silver iodide content of the whole silver halide grains.

By the terminology "the silver halide grains in which the silver iodide content is higher in the internal portion than in the surface portion thereof" is meant that when the silver halide grains are divided, for example, into a central portion and the surface portion having a 1/1 volume ratio, silver iodide exists in the central portion at a content from above 50% to 100%, preferably from above 50% to 95%, and more preferably from above 50% to 75%, and in the surface portion at a content of from 0% to less than 50%, preferably from 5% to less than 50%, and more preferably from 25% to less than 50%.

The silver iodide distribution in silver halide grains in this invention can be determined by the method of the combination of ion etching and X-ray photoelectron spectroscopy (ESCA) described in T. M. Kelly and M. G. Mason, *Journal of the Applied Physics,* Vol. 47, No. 11, page 4721 (1976) entitled "Profile of Halogen Composition in Fine Silver Halide Crystals".

In general, when a photographic material containing silver halide grains having a silver iodide content higher than 1.5 mole% is processed by a processing liquid containing a dialdehyde series hardening agent, images having poor image properties are obtained.

As a result of extensive investigation of the phenomenon of poor image properties obtained in the foregoing case, the inventor has found that the phenomenon appears to be caused by an infectious development to which silver iodide in the photographic material and a dialdehyde series hardening agent in the processing liquid contribute. By the terminology "infectious development" is meant that silver halide grains forming no latent image by image exposure are developed with the development of adjacent silver halide grains as a trigger. The occurrence of the infectious development may increase the apparent sensitivity of the photographic material, but simultaneously causes increased fog, changes in the characteristic curve of the photographic material, and leads to a deterioration in graininess.

Furthermore, as shown in Example 2 and Reference Example described hereinafter, the infectious development occurs significantly when a photographic material having a high content (i.e., over 1.5 mole%) of silver iodide in silver halide grains is processed by a processing liquid containing a dialdehyde series hardening agent. However, by employing the specific distribution of silver iodide in the silver halide grains of a photographic material as defined in this invention, the undesirable increase of sensitivity, which reduces the properties of images formed, caused by the infectious development as described above can be restrained without losing the increase of sensitivity expected by the increase of the silver iodide content.

The silver halide grains according to this invention include silver iodobromide, silver iodochloride, and silver iodochlorobromide. It is preferred that the content of silver iodide in the silver halide grains be in the range of from 2.2 to 30 mole%, and more preferably is from 2.5 to 10 mole %, of the total silver halide forming the grains. The preferred mean grain size of the silver halide grains is in the range of from 0.1 to 3 μm, and more preferably is 0.2 to 2 μm.

Also, the silver halide of this invention may have a regular crystal form, such as a cubic form or an octahedral form, or may have an irregular crystal form, such as a tabular form, or a spherical form. The silver halide of this invention is preferably spherical grains or regular grains such as cubic or octahedral grains, and more preferably octahedral grains.

The silver halide grains of this invention may be used as a part of silver halide grains used for silver halide photographic emulsion layer, preferably at a content higher than 20% by weight, and more preferably at a content higher than 50% by weight of the total weight of the silver halide grains.

Silver halide grains wherein the silver iodide distribution is homogeneous throughout the grains, or the silver iodide content is higher in the internal portion than in the surface portion of the silver halide grains can be prepared by the following known various methods.

That is, these methods are described, for example, in P. Glafkides, *Chimie et Physique Photographique* (published by Paul Montel, 1967), G. F. Duffin, *Photographic Emulsion Chemistry* (published by The Focal Press, 1966), V. L. Zelikman et al., *Making and Coating Photographic Emulsion* (published by The Focal Press, 1964), etc. That is, the silver halide grains of this invention may be prepared by an acid method, a neutralization method, an ammonia method, etc., and the reaction of a soluble silver salt and a soluble halogen for producing the silver halide grains of this invention can be performed by one-side mixing method, a simultaneous mixing method, or a combination thereof. Furthermore, a so-called reversal mixing method, that is, a method of forming silver halide grains under the presence of an excessive amount of silver ion, may also be employed. As one mode of the simultaneous mixing method, a so-called controlled double jet method, i.e., a method of maintaining pAg in the liquid phase forming silver halide at a constant value can also be used. According to the method, a silver halide emulsion having a regular crystal form and almost uniform mean grain size can be obtained.

In these cases, a method of introducing an iodide (e.g., potassium iodide, sodium iodide, etc.) into a mixing vessel before initiating the formation of the precipitates of the silver halide grains, a method of introducing an iodide into a solution of a halide in the simultaneous mixing method, or a method of further adding an aqueous solution of an iodide in any step of forming silver halide grains as a third component can be used.

As another preferred method of preparing silver halide grains, a method of preparing a core/shell type silver halide emulsion can be used. According to the method, a shell (coating layer) of a halogen composition containing iodine can be deposited on a core grain (internal nucleus) of the same halogen composition as that of the shell or having a larger iodine content than that of the shell. When the halogen composition of the core is different from that of the shell, it sometimes happens that the shell cannot easily be deposited, and hence in such a case, it is necessary to consider changing the critical supersaturation degree. That is, it is preferred to prevent the occurrence of the generation of new nuclei by controlling pAg, the reaction temperature, the kind and amount of a silver halide solvent, etc.; so that the silver halide grains are quickly grown while in a range not exceeding the critical supersaturation degree. Also, a method of increasing the addition mole number per unit time with the increase of the total surface areas of the silver halide grains is preferred. Also, when the shell is composed of silver bromide, a method of adding an aqueous solution of silver nitrate in the presence of core grains previously containing a bromide and silver iodide (one-side mixing method) can be used. Such methods are described in detail, for example, in U.S. Pat. No. 3,935,014, Japanese Patent Application (OPI) Nos. 38525/75 and 22408/78 (the term "OPI" as used herein refers to a "published unexamined Japanese patent application"), Japanese Patent Publication No. 13162/68, *Journal of Photographic Science,* Vol. 24, p. 198 (1976), U.S. Pat. No. 4,242,445, Japanese Patent Application (OPI) No. 158124/80, etc.

The formation or the physical ripening of the silver halide grains may be performed in the presence of a cadmium salt, a zinc salt, a lead salt, a thallium salt, an iridium salt or a complex salt thereof, a rhodium salt or a complex salt thereof, an iron salt or a complex salt thereof, etc.

Silver halide emulsions are usually chemically sensitized. For the chemical sensitization, the method described, for example, in H. Frieser, *Die Grundlagen der Photographischen Prozesse mit Silberhalogeniden,* pages 675–734 (published by Akademische Verlagsgesellschaft, 1968) can be used.

That is, silver halide emulsions can be sensitized by a sulfur sensitization method using active gelatin or a compound containing sulfur capable of reacting with silver (e.g., thiosulfates, thioureas, mercapto compounds, rhodanines, etc.); a reduction sensitization method using a reducing material (e.g., stannous salts, amines, hydrazine derivatives, formamidinesulfinic acid, silane compounds, etc.); a noble metal sensitization method using a noble metal compound (e.g., gold complex salts and complex salts of metals belongint to the Periodic Table, Group VIII, such as platinum, iridium, palladium, etc.), etc., solely, or using a combination of these methods.

As to the practical examples of these methods, the sulfur sensitization method is described, for example, in U.S. Pat. Nos. 1,574,944, 2,410,689, 2,278,947, 2,728,668, 3,656,955, etc.; the reduction sensitization method is described, for example, in U.S. Pat. Nos. 2,983,609, 2,419,974, 4,054,458, etc.; and the noble metal sensitization method is described, for example, in U.S. Pat. Nos. 2,399,083 and 2,448,060, British Pat. No. 618,061, etc.

The silver halide emulsions which are used in this invention can contain various compounds for purposes of preventing the formation of fog during the production, storage or photographic processing of the photographic materials of this invention and of stabilizing the photographic properties of the photographic materials. Examples of these additives are azoles such as benzothiazolium salts, nitroindazoles, triazoles, benzotriazoles, and benzimidazoles (in particular, the nitro- or halogen-substituted products thereof); heterocyclic mercapto compounds such as mercaptothiazoles, mercaptobenzothiazoles, mercaptobenzimidazoles, mercaptothiadiazoles, mercaptotetrazoles (in particular, 1-phenyl-5-mercaptotetrazole), mercaptopyrimidines; the above-described heterocyclic mercapto compounds further having a water-soluble group such as a carboxy group and a sulfo group; thioketo compounds such as oxazolinthion, etc.; azaindenes such as tetraazaindenes (in particular, 4-hydroxy-substituted (1,3,3a,7)tetraazaindenes); benzenethiosulfonic acids; benzenesulfinic acid, etc., which are known as antifoggants or stabilizers.

Detailed practical examples and the manner of using them are described, for example, in U.S. Pat. Nos. 3,954,474, 3,982,947 and 4,021,248, Japanese Patent Publication No. 28660/77.

The photographic materials of this invention may contain in the photographic silver halide emulsion layers and/or other hydrophilic colloid layers a dispersion of a water-insoluble or water sparingly soluble synthetic polymer for improving the dimensional stability of these layers. As such a synthetic polymer which is used for the purpose, there are polymers of, for example, an alkyl acrylate or methacrylate (hereinafter, is referred to as (meth)acrylate), an alkoxyalkyl (meth)acrylate, glycidyl (meth)acrylate, (meth)acrylamide, a vinyl ester (e.g., vinyl acetate), acrylonitrile, olefin, styrene, etc., solely or a combination of them, or further a combination of the foregoing monomer and acrylic acid, methacrylic acid, $\alpha,\beta$-unsaturated dicarboxylic acid, a hydroxyalkyl (meth)acrylate, a sulfoalkyl (meth)acrylate, styrenesulfonic acid, etc.

Practical examples of these polymers are described, for example, in U.S. Pat. Nos. 2,376,005, 2,739,137, 2,853,457, 3,062,674, 3,411,911, 3,488,708, 3,607,290, 3,635,715, 3,645,740, and 3,525,620, British Pat. Nos. 1,186,699, 1,307,373, etc.

The photographic silver halide emulsions of this invention may be spectrally sensitized by methine dyes, etc. These sensitizing dyes can be used solely or as a combination of them. A combination of sensitizing dyes is frequently used for the purpose of supersensitization. Also, the silver halide emulsions may further contain a dye which does not have a sensitizing action by itself or a material which does not substantially absorb visible light and shows a supersensitization together with the aforesaid sensitizing dye.

Examples of useful sensitizing dyes, combinations of dyes showing supersensitization, and materials showing supersensitization are described, for example, in *Research Disclosure,* Vol. 176, Item No. 17643 (published December 1978), page 23, IV, Paragraph J.

Furthermore, the silver halide emulsion layers of the photographic materials of this invention may further contain a polyalkylene oxide or the derivatives thereof, such as the ethers, esters, amines, etc., of polyalkylene oxide; thioether compounds, thiomorpholines, quaternary ammonium salt compounds; urethane derivatives; urea derivatives; imidazole derivatives; 3-pyrazolidone derivatives, etc., for increasing the sensitivity, increasing the contrast, or accelerating development. Practical examples of these additives are described, for example, in U.S. Pat. Nos. 2,400,532, 2,423,549, 2,716,062, 3,617,280, 3,772,021, and 3,808,003, British Pat. No. 1,488,991, etc.

As a binder or protective colloid for the silver halide emulsions for use in this invention, gelatin (e.g., limed gelatin, acid-treated gelatin, gelatin derivatives, gelatin graft polymers, etc.) is advantageously used, but other hydrophilic colloids, such as hydroxyethyl cellulose, polyvinyl alcohol, polyvinyl imidazole, etc., can also be used.

The photographic materials of this invention may further contain various surface active agents for various purposes, for example, as coating aids, as antistatic agents, for improving slipping property, for improving the dispersibility by emulsification, for the prevention of adhesion, and for improving photographic properties (e.g., acceleration of development, improvement of contrast, sensitization, etc.) in the silver halide emulsion layers and/or other hydrophilic colloid layers.

Examples of such surface active agents include, for example, nonionic surface active agents such as saponin (steroid series), alkylyene oxide derivatives (e.g., polyethylene glycol, a polyethylene glycol/polypropylene glycol condensation product, polyethylene glycol alkyl ethers, polyethylene glycol alkylaryl ethers, polyethylene glycol, polyethylene glycol esters, polyethylene glycol sorbitan esters, polyalkylene glycol alkylamines, polyalkylene glycol alkylamides, polyethylene glycol-addition products of silicone, etc.), glycidol derivatives (e.g., alkenylsuccinic acid polyglyceride, alkylphenol polyglyceride, etc.), fatty acid esters of polyhydric alcohols, alkyl esters of sugar, etc.; anionic surface active agents containing acid groups (e.g., a carboxy group, a sulfo group, a phospho group, a sulfuric acid ester group, a phosphoric acid ester group, etc.), such as alkyl carboxylates, alkyl sulfonates, alkylbenzenesulfonates, alkylnaphthalenesulfonates, alkylsulfuric acid esters, alkylphosphoric acid esters, N-acyl-N-alkyltaurines, sulfosuccinic acid esters, sulfoalkyl polyoxyethylene alkylphenyl ethers, polyoxyethylene alkylphosphoric acid esters, etc.; amphoteric surface active agents such as amino acids, aminoalkylsulfonic acids, aminoalkylsulfuric acid esters, aminoalkylphosphoric acid esters, alkylbetaines, amine oxides, etc.; and cationic surface active agents such as alkylamines, aliphatic or aromatic quaternary ammonium salts, heterocyclic quaternary ammonium salts (e.g., pyridiniums, imidazoliums, etc.), and phosphonium salts or sulfonium salts containing aliphatic or heterocyclic rings.

The photographic materials of this invention can further contain, if desired, other various additives, such as dyes, hardening agents, optical whitening agents, etc. Practical examples of these additives are described in *Research Disclosure,* No. 176, pages 28–30 (RD-17643, 1978).

In the photographic material of this invention, the silver halide emulsion layers may be formed not only on one surface of a support, but also on both surfaces thereof.

The silver halide photographic material may have a protective layer composed of a hydrophilic colloid and the above-described hydrophilic colloids in regard to the silver halide emulsion layers can be also used for the protective layer. Also, the protective layer may be a single layer or double layers.

The silver halide photographic material of this invention may contain a matting agent and/or a lubricant in the silver halide emulsion layer or the protective layer, preferably in the protective layer. Examples of the matting agent are an organic compound, for example, a water-dispersible vinyl polymer such as polymethyl methacrylate, etc., or an inorganic compound such as silver halide, strontium barium sulfate, etc., having an appropriate particle size (preferably, particle sizes of from 0.3 to 5 microns or particle sizes more than twice, and preferably more than 4 times larger than, the thickness of the protective layer). The lubricants are effective for the prevention of adhesion as in the case of the matting agent, and are as well particularly effective for improving the abrasion characteristics in relation to the camera adaptability of cine films during photographing and projection. Practical examples of such lubricants are waxes such as liquid paraffin, higher fatty acid esters, etc.; polyfluorohydrocarbons or the derivatives thereof; and silicones such as polyalkylpolysiloxane, polyarylpolysiloxane, polyalkylarylpolysiloxane, and the alkylene oxide-addition derivatives thereof.

For the silver halide photographic materials of this invention, if desired, antihalation layers, interlayers, filter layers, etc., may be further formed in addition to the above-described layers.

The present invention can be applied to X-ray photographic materials (or radiographic light-sensitive materials) and other various photographic materials.

The photographic materials of this invention can be processed by using known processes and known processing liquids as described, for example, in *Research Disclosure,* No. 176, pages 28–30 (RD-17643, 1978). The photographic processing may be a photographic process for forming silver image (black-and-white photographic process) or a photographic process for forming dye images (color photographic process) according to the purpose or kind of the photographic materials of this invention. The processing temperature is usually selected in the range of from 18° C. to 50° C., but if desired a processing temperature lower than 18° C. or higher than 50° C. may be employed.

In the case of performing a black-and-white photographic process, a developer containing a known developing agent can be used. As such a developing agent which is used in such a case, there are dihydroxybenzenes (e.g., hydroquinone), 3-pyrazolidones (e.g., 1-phenyl-3-pyrazolidone), aminophenols (e.g., N-methyl-p-aminophenol), etc. They may be used solely or as a combination thereof.

The developer may further contain a preservative, an alkali agent, a pH buffer, an antifoggant (e.g., benzotriazoles such as methylbenzotriazole, nitrobenzotriazole, etc.; benzothiazoles; indazoles; tetrazoles; thiazoles, etc.), etc., which are typically used for such developers. Furthermore, the developer may contain, if desired, a dissolution assistant, a toning agent, a development accelerator, a surface active agent, a defoaming agent, a water softener, a hardening agent, a tackifier, etc.

The pH of the developer is usually from 9 to 11, and preferably from 9.5 to 10.5.

A fixing solution having a conventional composition can be used. As a fixing agent, a thiosulfate, a thiocyanate as well as an organic sulfur compound which is known to have an effect as a fixing agent may be used. The fixing solution may further contain a water-soluble aluminum salt as a hardening agent.

The following examples are intended to illustrate the invention but not to limit it in any way.

EXAMPLE 1

(1) Preparation of silver iodobromide emulsion (2.8 mole% silver iodide) homogeneously containing silver iodide:

While maintaining the pAg of an aqueous solution containing 2.5 g of thioether and 30 g of gelatin and maintained at 75° C. at 8.9, an aqueous silver nitrate solution (1.18 moles) and a mixed aqueous solution of potassium bromide and potassium iodide were simultaneously added to the aqueous solution to provide monodispersed type octahedral silver iodobromide grains (2.8 mole% silver iodide) having a mean grain size of 1.2μ. Salts formed were removed from the silver halide grains by an ordinary sedimentation method and then the silver halide grains were dispersed again in an aqueous gelatin solution. The silver halide grains were subjected to a chemical sensitization by a gold sulfur sensitization method using chloroauric acid and a rhodanine sulfur sensitizer, to provide Silver Iodobromide Emulsion (A) (2.8 mole% silver iodide) homogeneously containing silver iodide.

(2) Preparation of silver iodobromide emulsion (2.8 mole%) wherein silver iodide is predominantly distributed in the central portion of the silver halide grains:

While maintaining the pAg of the aqueous gelatin solution having the same composition as above process (1) at 8.6, an aqueous silver nitrate solution (0.59 mole) and a mixed aqueous solution of potassium bromide and potassium iodide were simultaneously added to the aqueous gelatin solution to provide monodispersed type octahedral silver iodobromide core grains (5.6 mole% silver iodide) and then while maintaining the pAg of the system at 9.0, an aqueous silver nitrate solution (0.59 mole) and an aqueous potassium bromide solution were simultaneously added to the system to deposit a shell to each core, whereby a monodispersed octahedral silver iodobromide emulsion (2.8 mole% silver iodide) having a mean grain size of 1.2μ was prepared. Then, by performing desalting, re-dispersion and chemical sensitization as in process (1), Silver Iodobromide Emulsion (B) (2.8 mole% silver iodide) which silver iodide largely distributed in the central portion of the silver halide grain, was prepared.

(3) Preparation of silver iodobromide emulsion (2.8 mole% silver iodide) wherein silver iodide is largely distributed in the surface portion of the silver halide grains:

While maintaining the pAg of the aqueous gelatin solution having the same composition as in process (1), an aqueous silver nitrate solution (0.59 mole) and an aqueous potassium bromide solution were simultaneously added to the aqueous solution to provide monodispersed octahedral silver bromide core grains. Then, while maintaining the pAg of the system at 8.6, an aqueous silver nitrate solution (0.59 mole) and a mixed aqueous solution of potassium bromide and potassium iodide were simultaneously added to the system to deposit a shell onto each core to provide a monodispersed octahedral silver iodobromide emulsion (2.8 mole% silver iodide) having a mean grain size of 1.2μ. Then, by performing desalting, re-dispersion, and chemical sensitization as in process (1), Silver Iodobromide Emulsion (C) (2.8 mole% silver iodide) wherein silver iodide largely distributed in the surface portion of the silver halide grains was prepared.

In addition, silver halide grains were collected from each of Silver Iodobromide Emulsions (A), (B) and (C) thus prepared, and the distribution of silver iodide, that is, the ratio of the silver iodide peak to the silver bromide peak from the surface of the grain to the center of the grain was measured by a combination of ion etching and ESCA on individual silver halide grains.

As a result thereof, it has been confirmed that the distribution of silver iodide is homogeneous from the surface of the grain to the center thereof on Silver Iodobromide Emulsion (A), the distribution of silver iodide is large in the internal portion of the grain on Silver Iodobromide Emulsion (B), and the distribution of silver iodide is large in the surface portion of Silver Iodobromide Emulsion (C).

(4) Preparation of coated samples and evaluation of image characteristics:

To each of above-described Silver Iodobromide Emulsions (A), (B) and (C) was added 4-hydroxy-6-methyl-1,3,3a,7-tetraazaindene and, then, each of the emulsions thus obtained and an aqueous gelatin solution for a protective layer were coated, in succession, on a polyester film having a subbing layer to provide Sample (1) containing Emulsion (A), Sample (2) containing Emulsion (B), and Sample (3) containing Emulsion (C). In this case, the silver coverage of each of Samples (1), (2), and (3) was 4.0 g/m$^2$, the gelatin coverage of each of the protective layers was 1.3 g/m$^2$, and the gelatin coverage of each of the silver halide emulsion layers was 2.7 g/m$^2$.

Each of Samples (1), (2), and (3) thus prepared was wedge exposed, developed by Developer I containing glutaraldehyde as the dialdehyde series hardening agent and having the following composition using an automatic process (RN Automatic Processor, made by Fuji Photo Film Co., Ltd.) for 25 seconds at 35° C. after passing therethrough a photographic material to bring the processor into a running state, and then fixed, washed, and dried. Thereafter, a sensitometry and the measurement of the R.M.S. granularity (Root Mean Square granularity) were performed on each image thus obtained.

| Composition of Developer I: | |
|---|---|
| Potassium Hydroxide | 29.14 g |
| Glacial Acetic Acid | 10.96 g |
| Sodium Sulfite | 44.20 g |
| Sodium Hydrogencarbonate | 7.50 g |
| Boric Acid | 1.00 g |
| Diethylene Glycol | 28.96 g |
| Ethylenediaminetetraacetic Acid | 1.67 g |
| 5-Methylbenzotriazole | 0.06 g |
| 5-Nitroindazole | 0.25 g |
| Hydroquinone | 30.00 g |
| 1-Phenyl-3-pyrazolidone | 1.50 g |
| Glutaraldehyde | 4.93 g |
| Sodium Metahydrogensulfate | 12.60 g |
| Potassium Bromide | 3.70 g |
| Water to make | 1 liter (pH was adjusted to 10.25) |

The results obtained are shown in Table 1 and the FIGURE.

The FIGURE shows the characteristic curves relative to Samples (1) to (3) obtained in Example 1, wherein the axis of ordinate shows an optical density (O.D.) and the axis of abscissa shows the logarithm of exposure amount (log E).

TABLE 1

| | | Photographic Characteristics | | | | |
|---|---|---|---|---|---|---|
| Sample No. | Emulsion | R.S.* | Fog | Gamma | $D_{max}$ | RMS Granularity D = 0.6 |
| (1) | (A) | 100 | 0.015 | 2.58 | 1.55 | 0.036 |
| (2) | (B) | 110 | 0.005 | 2.28 | 1.44 | 0.052 |

TABLE 1-continued

| Sample No. | Emulsion | Photographic Characteristics R.S.* | Fog | Gamma | $D_{max}$ | RMS Granularity D = 0.6 |
|---|---|---|---|---|---|---|
| (3) | (C) | 229 | 0.250 | 1.02 | 1.65 | 0.083 |

*: Relative Sensitivity shown by defining the sensitivity of Sample (1) to be 100.
Sample Nos. (1) and (2): Sample of this invention.
Sample No. (3): Comparison Sample.

As is clear from the results shown in Table 1 and the FIGURE, it can be seen that although Samples (1) and (2) of this invention show a relatively low sensitivity as compared to comparison Sample (3), the Samples of this invention show remarkably less fog formation, less distortion of characteristic curves, and low RMS granularity, that is, good graininess.

EXAMPLE 2

This example shows that the effect of this invention against the increase of fog occurring in the case of processing photographic materials by a processing liquid containing a dialdehyde series hardening agent, the change of characteristic curve, and the deterioration of graininess becomes remarkable when the silver iodide content of silver halide grains in a photographic material is higher than 1.5 mole%.

(1) Preparation of various silver iodobromide emulsions each having different silver iodide content:

While maintaining the pAg of the aqueous gelatin solution having the same composition as in Example 1 (1) at 9.0, an aqueous silver nitrate solution (1.18 moles) and an aqueous potassium bromide solution were simultaneously added to the gelatin solution to provide monodispersed octahedral pure silver bromide grains having a mean grain size of 1.2μ, and then performing desalting, re-dispersion, and chemical sensitization as in Example 1, Silver Bromide Emulsion (D) containing no silver iodide was prepared.

Furthermore, while maintaining the pAg of the aqueous gelatin solution having the same composition as in Example 1 (1) at 9.0, an aqueous silver nitrate solution (1.18 moles) and a mixed aqueous solution of potassium bromide and potassium iodide were simultaneously added to the gelatin solution to provide monodispersed octahedral silver iodobromide grains (1.5 mole% silver iodide) having a mean grain size of 1.2μ and then by performing desalting, re-dispersion and chemical sensitization as in Example 1, Silver Iodobromide Emulsion (E) (1.5 mole% silver iodide) homogeneously containing silver iodide was prepared.

Moreover, while maintaining the pAg of the aqueous gelatin solution having the same composition as in Example 1 (3) at 9.0, an aqueous silver nitrate solution (0.59 mole) and an aqueous potassium bromide solution were simultaneously added to the gelatin solution to provide monodispersed octahedral silver bromide core grains, and then while maintaining the pAg of the system at 8.9, an aqueous silver nitrate solution (0.59 mole) and a mixed aqueous solution of potassium bromide and potassium iodide were simultaneously added to the system to deposit a shell on each core to provide a monodispersed octahedral silver iodobromide emulsion (1.5 mole% silver iodide) having a mean grain size of 1.2μ. Then, by performing desalting, re-dispersion and chemical sensitization as in Example 1, Silver Iodobromide Emulsion (F) (1.5 mole% silver iodide) wherein silver iodide largely distributed in the surface portion of each silver halide grain was prepared.

(2) Preparation of coated samples and evaluation of image characteristics:

To each of Silver Halide Emulsions (D), (E) and (F) prepared in the foregoing steps was added 4-hydroxy-6-methyl-1,3,3a,7-tetraazaindene, and each emulsion and an aqueous gelatin solution as a protective layer were coated in succession on a polyester film having a subbing layer to provide Sample (4) containing Emulsion (D), Sample (5) containing Emulsion (E) and Sample (6) containing Emulsion (F). In this case, the silver coverage of each of Emulsions (D), (E) and (F) was 4.0 g/m$^2$, the gelatin coverage of each of the protective layers was 1.3 g/m$^2$, and the gelatin coverage of each of the emulsion layers was 2.7 g/m$^2$.

Each of Samples (4) to (6) thus prepared and Samples (1) and (3) prepared in Example 1 was processed by means of an automatic processor using Developer I and the same process as in Example 1, and the sensitometry and the measurement of RMS granularity were performed on each image thus obtained.

The results thus obtained are shown in Table 2.

TABLE 2

| Sample No. | Emulsion | Photographic Characteristics R.S.* | Fog | Gamma | $D_{max}$ | RMS Granularity D = 0.6 |
|---|---|---|---|---|---|---|
| (4) | (D) | 100 | 0.010 | 1.73 | 1.50 | 0.028 |
| (5) | (E) | 123 | 0.015 | 2.22 | 1.76 | 0.031 |
| (6) | (F) | 125 | 0.015 | 2.20 | 1.64 | 0.038 |
| (1) | (A) | 148 | 0.015 | 2.58 | 1.55 | 0.036 |
| (3) | (C) | 229 | 0.250 | 1.02 | 1.65 | 0.083 |

*: Relative Sensitivity shown by defining the sensitivity of Sample (4) as 100.
Sample (1) is the sample of this invention.

From the results shown in Table 2, several facts can be seen. More particularly, when the silver halide grains contain 1.5 mole% silver iodide, there is no particular difference in photographic properties between Sample (5) containing Emulsion (E) composed of the silver halide grains having homogeneous distribution of silver iodide throughout the grain and Sample (6) containing Emulsion (F) composed of the silver halide grains having a larger silver iodide content in the surface portion of each grain. On the other hand, when the silver halide grains contain 2.6 mole% silver iodide, Sample (1) of this invention containing Emulsion (A) composed of silver halide grains having homogeneous distributon of silver iodide shows greatly restrained formation of fog, the prevention of reduced contrast, and the remarkable improvement of graininess as compared to Sample (3) containing Emulsion (C) composed of silver halide grains having a high distribution of silver iodide in the surface portion of each grain.

Thus, the effect of this invention becomes remarkable when the silver iodide content of the silver halide grains is over 1.5 mole%.

Also, in regard to relative sensitivity, Sample (1) of this invention can greatly increase the sensitivity while restraining the formation of fog as compared to Sample (4) containing no silver iodide.

REFERENCE EXAMPLE

This reference example shows that the effect of this invention remarkably occurs when the photographic material containing silver iodide of more than 1.5 mole% in the silver halide emulsion as shown in Examples 1 and 2 is processed by a processing liquid containing a dialdehyde series hardening agent, but is not remarkable when the processing liquid does not contain a dialdehyde series hardening agent, and even further in such a case, the increase in sensitivity is retained by increasing the content of silver iodide.

After wedge-exposing each of Samples (1) to (6) described in Examples 1 and 2, each sample was developed conventionally (by the way of sink line operation without using an automatic processor) for 25 seconds at 35° C. using the developer having the same composition as Developer I described in Example 1, except that glutaraldehyde as a dialdehyde series hardening agent was removed, and after performing stop, fix, wash, and drying, sensitometry was performed on the images thus formed.

The results thus obtained are shown in Table 3.

TABLE 3

| Sample No. | Emulsion | Photographic Characteristics | | | |
|---|---|---|---|---|---|
| | | *Relative Sensitivity | Fog | Gamma | $D_{max}$ |
| (4) | (D) | 100 | 0.02 | 1.66 | 1.41 |
| (5) | (E) | 135 | 0.03 | 2.42 | 1.79 |
| (6) | (F) | 125 | 0.02 | 2.40 | 1.67 |
| (1) | (A) | 155 | 0.02 | 2.22 | 1.59 |
| (2) | (B) | 174 | 0.01 | 1.90 | 1.42 |
| (3) | (C) | 135 | 0.08 | 1.95 | 1.62 |

Relative Sensitivity: Shown by defining the sensitivity of Sample (4) as 100.

From the results shown in Table 3, it can be seen that in the case of processing with a processing liquid containing no dialdehyde series hardening agent, the sample composed of a silver halide emulsion having a small silver iodide content and the sample composed of a silver halide emulsion having a large silver iodide content do not show remarkable changes of fog and gradation (gamma) by the difference of the distribution of silver iodide in the silver halide grain (by comparison of Sample (5) and Sample (6), and the comparison of Samples (1), (2) and (3)).

EXAMPLE 3

While maintaining the pAg of the aqueous gelatin solution having the same composition as in Example 1 (1) at 8.6, an aqueous silver nitrate solution (1.18 moles) and a mixed aqueous solution of potassium bromide and potassium iodide were simultaneously added to the gelatin solution to provide monodispersed octahedral silver iodobromide grains (5.6 mole% silver iodide) having a mean grain size of 1.2μ, and then by performing desalting, re-dispersion, and chemical sensitization as in Example 1, Silver Iodobromide Emulsion (G) (5.6 mole% silver iodide) homogeneously containing silver halide in the silver halide grain was prepared. Then, a coated sample was prepared by the same manner as in Example 1 and processed as in Example 1. The result of the sensitometry applied to the image thus formed showed that the increase of fog was restrained, distortion of the characteristic curve was not caused, and the graininess was improved.

While the invention has been described in detail and with reference to specific embodiments thereof, it will be apparent to one skilled in the art that various changes and modifications can be made therein without departing from the spirit and scope thereof.

What is claimed is:

1. A development method for a silver halide photographic material, wherein an imagewise exposed silver halide photographic material comprising a support having thereon at least a silver halide emulsion layer containing silver halide grains having a silver iodide content higher than 1.5 mole%, and having a silver iodide distribution in the silver halide grains that is homogeneous throughout the grains or a silver iodide content present in the central portion of the grains from above 50% to 95% and a silver iodide content present in the surface portion of the grains from 5% to less than 50%, is processed using a processing liquid containing a dialdehyde series hardening agent, whereby fog is reduced.

2. A development method as in claim 1, wherein the silver iodide distribution in the silver halide grains is homogeneous throughout the grains such that the silver iodide content of any portion of a grain is within 10% of the mean silver iodide content of the whole silver halide grain.

3. A development method as in claim 2, wherein the silver iodide distribution in the silver halide grains is homogeneous throughout the grains such that the silver iodide content of any portion of a grain is within 5% of the mean silver iodide content of the whole silver halide grain.

4. A development method as in claim 1, wherein the silver iodide content is higher in the internal portion than in the surface portion of the silver halide grains, such that the central portion and the surface portion of the grains have a 1/1 volume ratio.

5. A development method as in claim 4, wherein the silver iodide content present in the central portion is from above 50% to 75% and the content present in the surface portion is from 25% to less than 50%.

6. A development method as in claim 1, wherein the silver iodide content of the silver halide grains is from 2.2 to 30 mole%.

7. A development method as in claim 6, wherein the silver iodide content of the silver halide grains is from 2.5 to 10 mole%.

8. A development method as in claim 1, wherein said silver halide grains have a spherical form or a regular crystal form.

9. A development method as in claim 8, wherein the regular crystal form is an octahedral form.

10. A development method as in claim 1, wherein the processing liquid is a developer.

11. A development method as in claim 1, wherein the processing liquid is a pre-bath being used before a developer, and the silver halide photographic material is developed by a developer after processing with the pre-bath.

12. A development method as in claim 1, wherein an amount of the dialdehyde series hardening agent is from 1 to 20 g per liter of the processing liquid.

13. A development method as in claim 12, wherein the amount of the dialdehyde series hardening agent is from 3 to 15 g per liter of the processing liquid.

14. A development method is claimed in claim 1, wherein processing in said liquid containing a dialdehyde series hardening agent is carried out at a temperature of about 18° C. or higher.

15. A method of reducing fog in a silver halide photographic material containing a silver halide emulsion layer containing silver halide grains having a silver iodide content higher than 1.5 mol% which is processed using a processing liquid containing a dialdehyde series hardening agent at temperature, comprising:

processing the imagewise exposed silver halide photographic material comprising a support having thereon at least a silver halide emulsion layer containing silver halide grains having a silver iodide content higher than 1.5 mol%, and having a silver iodide distribution in the silver halide grains that is homogeneous throughout the grains or a silver iodide content present in the central portion of the grains from above 50% to 95% and a silver halide content present in the surface portion of the grains from 5% to less than 50%, in a processing liquid containing a dialdehyde series hardening agent at a temperature of above 18° C. or higher.

* * * * *